US005821213A

United States Patent [19]

Burke et al.

[11] Patent Number: 5,821,213

[45] **Date of Patent: *Oct. 13, 1998**

[54] AQUEOUS BASED SOLVENT FREE DEGREASER COMPOSITION COMPRISING A TERNARY MIXTURE OF NONIONIC ALKOXYLATES

[76] Inventors: John J. Burke, 306 W. Shore Trail, Sparta, N.J. 07871; Joanne P. Gorczyca, 34048 Fonville, Livonia, Mich. 48152; Gregory W. Drewno, 18237 Valade, Riverview, Mich. 48192

[ * ] Notice: The term of this patent shall not extend beyond the expiration date of Pat. No. 5,501,816.

[21] Appl. No.: 564,724

[22] Filed: Nov. 29, 1995

Related U.S. Application Data

[62] Division of Ser. No. 273,690, Jul. 12, 1994, Pat. No. 5,501,816.

[51] Int. Cl.[6] ..... C11D 1/825; C11D 3/37

[52] U.S. Cl. ..... 510/365; 510/245; 510/254; 510/422; 510/434; 510/476; 510/506

[58] Field of Search ..... 510/245, 254, 510/365, 422, 434, 421, 506, 476

[56] References Cited

U.S. PATENT DOCUMENTS

| | | | |
|---|---|---|---|
| 3,382,176 | 5/1968 | Jakobi et al. | 510/514 |
| 3,737,387 | 6/1973 | Marple | 510/338 |
| 4,233,171 | 11/1980 | McLaughlin et al. | 510/231 |
| 4,836,951 | 6/1989 | Tolten et al. | 510/220 |
| 5,080,831 | 1/1992 | Van Eenam | 510/365 |
| 5,126,068 | 6/1992 | Burke et al. | 510/421 |
| 5,350,457 | 9/1994 | Kitazawa et al. | 134/10 |
| 5,501,816 | 3/1996 | Burke et al. | 510/365 |

FOREIGN PATENT DOCUMENTS 0251689 11/1987 Germany .

*Primary Examiner*—Ardith Hertzog
*Attorney, Agent, or Firm*—Joanne P. Will

[57] ABSTRACT

An aqueous based, solvent free degreaser composition, has on a weight basis:

a) about 0.5–10% of at least one alcohol alkoxylate with a fatty alcohol moiety selected from the group of compounds having the formula:

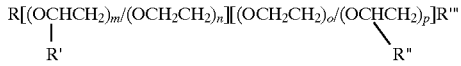

wherein R is a $C_8$ to $C_{18}$ branched or straight chain alkyl group, m is within the range of about 0 to 14, n is within the range of about 0 to 14, o is within the range of about 0–14, p is within the range of about 0–14, and R' is —$CH_3$, —$CH_2CH_3$, and mixtures thereof, R" is —$CH_3$, —$CH_2CH_3$, and mixtures thereof, and R'" is —OH, —$CH_3$, —O—$C_3$–$C_{18}$hydroxyalkyl group and mixtures thereof;

b) about 0.5–10% of at least one alkyl phenol alkoxylate of the following formula:

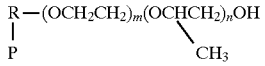

wherein R is a $C_8$ or $C_9$ branched or straight chain alkyl group, m is within the range of about 3 to 12, and n is within the range of about 0 to 12, and P is a phenyl group;

c) about 0.5–10% of at least one alkyl oxyethylate of the following formula:

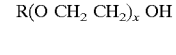

wherein R is a $C_{10}$ to $C_{13}$ branched or straight chain alkyl group and x is within the range of about 4 to 10; and d) water.

15 Claims, No Drawings

AQUEOUS BASED SOLVENT FREE DEGREASER COMPOSITION COMPRISING A TERNARY MIXTURE OF NONIONIC ALKOXYLATES

This application is a division of application Ser. No. 08/273,690, filed Jul. 12, 1994, now U.S. Pat. No. 5,501,816.

FIELD OF THE INVENTION

The present invention relates to an aqueous based, solvent free degreaser composition, and more particularly to a mixture of nonionic surfactants which effectively clean metal surfaces of oils and greases. The addition of polycarboxylated based polymers and copolymers further enhances cleaning efficacy.

BACKGROUND OF THE INVENTION

The demand for degreasing formulations for a myriad of cleaning applications is well known. Target applications range from the light cleaning of printed electronic circuit boards to the cleaning of used automotive parts. Many formulations for these purposes contain varied levels of volatile solvents to efficiently degrease surfaces. Many heavy duty degreasing operations use heated solvent baths.

Recent concerns for environmental and toxicological effects of solvents and solvent baths have caused a full search for aqueous degreasing systems without solvent. Few surfactant based systems have been successful without at least a minor amount of solvent, for the dual purpose of cleaning and defoaming. Hence, industrial and institutional cleaning operations that require degreasing must compromise their desire to be socially conscious to remain effective.

The use of glycol ether solvents or cycloalkanes, in combination with anionic and/or nonionic surfactants, are known in the art. Examples of such systems may be found in Wittel et al., EP 376367; Kao Corporation, JP 3062896; Lyubarskay et al., SU 1300041; Bedo et al., SU T56873; and Dudesek et al., CS 8105867.

Bobsein and Bresson, U.S. Pat. No. 4,663,082 teach a water based cleaning technology based on a series of anionic surfactants, builders and alkalinity agents. Thus, a high pH is required with U.S. Pat. No. 4,663,082 in order to clean effectively. In addition, the patentees teach the use of phosphate builders and chelating agents.

Henkel AG World Organization Patent No. 91/10718 requires at least one anionic surfactant and at least, one monocarboxylic acid.

European Patent No. 0392394A1 issued to the Nippon Paint Co. of Japan teaches the use of a surf actant package that requires an alcohol alkoxylate with a phosphate ester. This mix is combined with a necessary amount of alkali builder of varying types. Phosphate esters are notorious for increasing the generation of foam. Also, phosphate esters also contain residual phosphorous, an environmental concern. The nominal amount of alkali builder results in a caustic solution.

Finally, European Patent No. 0084411A1 assigned to Albright & Wilson Limited teaches the use of a wide variety of nonionic surf actants or a phosphate ester with a necessary amount of an alkanolamide and solvent.

What is needed in the art is an effective aqueous based degreaser composition that can be utilized in industrial degreasing operations which utilize elevated cleaning solution temperatures and high spray pressures. This formulation should be solvent free, contain no alkalinity or chelating agents, and should also be low foaming.

OBJECTS OF THE INVENTION

It is therefore an object of the present invention to provide an effective aqueous based, degreaser composition.

It is also an object to provide a degreaser composition which exhibits a high degree of efficacy in industrial applications, particularly the degreasing of all metal surfaces.

A further object of the invention is to provide a degreaser composition which utilizes a combination of nonionic surfactants.

Another object is to provide a degreaser formulation which has a combination of nonionic surfactants and polycarboxylated based polymers and copolymers.

A still further object is to provide a composition which is highly effective in degreasing metal surfaces which is low foaming.

The invention also has as its object to provide a degreaser composition which is solvent free and contains no alkalinity or chelating agents.

Another object is to provide a degreaser formulation which is phosphate free.

SUMMARY OF THE INVENTION

These and other objects of the invention are attained by providing an aqueous based, solvent free degreaser composition, comprising on a weight basis:

a) about 0.5–10% of at least one alcohol alkoxylate with a fatty alcohol moiety selected from the group of compounds having the formula:

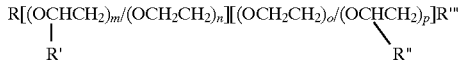

wherein R is a $C_8$ to $C_{18}$ branched or straight chain alkyl group, m is within the range of about 0 to 14, n is within the range of about 0 to 14, o is within the range of about 0–14, p is within the range of about 0–14, and R' is —$CH_3$, —$CH_2CH_3$, and mixtures thereof, R" is —$CH_3$, —$CH_2CH_3$, and mixtures thereof, and R'" is —OH, —$CH_3$, —O—$C_{3-C18}$ hydroxyalkyl group and mixtures thereof;

b) about 0.5–10% of at least one alkyl phenol alkoxylate of the following formula:

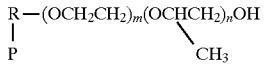

wherein R is a $C_8$ or $C_9$ branched or straight chain alkyl group, m is within the range of about 3 to 12, and n is within the range of about 0 to 12, and P represents a phenyl group;

c) about 0.5–10% of at least one alkyl oxyethylate of the following formula:

$$R\ (O\ CH_2\ CH_2)_x\ OH$$

wherein R is a $C_{10}$ to $C_{13}$ branched or straight chain alkyl group and x is within the range of about 4 to 10; and d) water. In the above composition, there is the proviso that components a) and c) not be the same compounds.

The above formulation may also contain about 0.005 to 1% of at least one polycarboxylate polymer of the following formula:

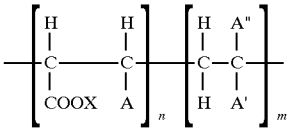

wherein x=H, Na or similar alkali or alkaline metal, A=H, COOH, COONa or similar salts, A' is COOH, COONa, or similar salts, or —$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer is within the range of about 1,000–70,000.

Also provided as part of the invention is a method of degreasing metallic surfaces utilizing one or more the formulations heretofore set forth.

DETAILED DESCRIPTION OF THE PREFERRED EMBODIMENTS

The degreaser composition according to the invention will comprise three nonionic surfactants. The first of these is an alcohol alkoxylate with a fatty alcohol moiety. The compound will have the following formula:

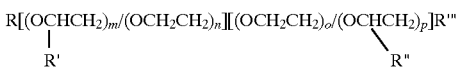

wherein R is a $C_8$ to $C_{18}$ branched or straight chain alkyl group, m is within the range of about 0 to 14, n is within the range of about 0 to 14, o is within the range of about 0–14, p is within the range of about 0–14, and R' is —$CH_3$, —$CH_2CH_3$, and mixtures thereof, R" is —$CH_3$, —$CH_2CH_3$, and mixtures thereof, and R'" is —OH, —$CH_3$, —O—$C_{3-C18}$ hydroxyalkyl group and mixtures thereof. R'" can be, for example, —O—$C_4H_9$. In a preferred embodiment, the oxyethylate level or value of n plus o will range from about 5 to 12, and even more preferably from about 4 to 10. The oxypropylate level or value of m plus p will preferably be about 4 to 7. Those skilled in the art may find that butylene oxide may also be incorporated into the alcohol alkoxylate.

An especially preferred alcohol alkoxylate is the nonionic surfactant having a carbon chain length of $C_{12-15}$ with approximately 10 moles total of oxyethylate and approximately 5 moles total of oxypropylate, where m=1.5, n=1, o=9, and p=3.5 (Surfactant C in the examples).

The alcohol alkoxylate in its various embodiments will make up about 0.5 to 10% by weight of the total degreaser composition. More preferably, this component will comprise about 2 to 8% of the total composition, and even desirably will be present in an amount of about 2.5 to 7% by weight of the total formulation.

The second nonionic surfactant useful as part of the composition of the invention is an alkyl phenol alkoxylate of the following formula:

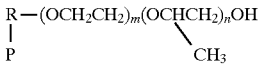

wherein R is a $C_8$ or $C_9$ branched or straight chain alkyl group, m is within the range of about 3 to 12, and n is within the range of about 0 to 12. Preferably the oxyethylate range or value of m will range from about 3 to 12 moles, and even desirably from about 8 to 12 moles. Other oxyalkylation may be incorporated as desired. In the above formula, P represents a phenyl group.

Especially preferred as the alkyl phenol alkoxylate nonionic surfactant component is a product known as Iconol™ OP 10 surfactant, available from BASF Corporation. This compound has a carbon chain length of 8 and an oxyethylate value of 10 moles. The oxypropylate or n value is zero (this product is referred to as OP 10 in the examples).

The alkyl phenol alkoxylate component in the embodiments heretofore set forth will make up about 0.5 to 10% by weight of the total degreaser composition. More preferably, this component will comprise about 2 to 8% of the total composition, and even desirably will be present in an amount of about 2.5 to 7% by weight of the total formulation.

A third nonionic surfactant for use in the composition of the invention is an alkyl oxyethylate of the following formula:

$$R\ (O\ CH_2\ CH_2)_x\ OH$$

wherein R is a C10 to $C_{13}$ branched or straight chain alkyl group and x is within the range of about 4 to 10. Preferably, the carbon chain length or value of R will be about 12 or 13. Other oxyalkylation may be additionally incorporated as desired.

An especially useful alkyl oxyethylate nonionic surfactant with the above formula is available from BASF Corporation under the name Iconol™ TDA 6 surfactant. This product is a tridecyl alcohol with six moles of oxyethylate (referred to as TDA 6 in the examples).

The alkyl oxyethylate nonionic surfactant of the invention will comprise about 0.5 to 10% by weight of the total degreaser composition. More preferably, this component will comprise about 2 to 8% of the total composition, and even desirably will be present in an amount of about 2.5 to 7% by weight of the total formulation.

The relative ratios of the three nonionic surfactants set forth above may range from about 2:1:1 to about 1:2:1 to about 1:1:2. In one desirable embodiment, there will be equal weight concentrations of all three nonionic surfactant components.

The remainder of the degreaser composition will comprise water.

It has also been found that the ternary combination of the above combination of nonionic surf actants together with at least one polycarboxylate based polymer or copolymer further enhances the efficacy of the degreaser composition.

Preferably, the polycarboxylate polymer or copolymer has the following formula:

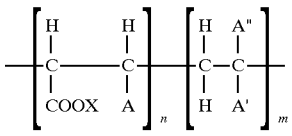

wherein x=H, Na or similar alkali or alkaline metal, A=H, COOH, COONa or similar salts, A' is COOH, COONa, or similar salts, or —$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer or copolymer is within the range of about 1,000–70,000. (Unless otherwise specified, all molecular weights herein are expressed in terms of weight average molecular weight, or $M_w$).

Polyacrylic acid having the above formula is useful as the polycarboxylate additive. An excellent copolymer having the above formula is acrylic acid/maleic acid copolymer. Those skilled in the art may also find that certain mixtures of polymers and copolymers according to the formula heretofore set forth may also may utility as part of the degreaser composition, and therefore these are also within the scope of the invention.

Illustrative methods for preparing the various useful polycarboxylate polymers and copolymers of the invention may be found in Burke et al., U.S. Pat. No. 5,126,068, incorporated herein by reference.

An especially preferred monomer ratio for the polycarboxylate copolymer is about 1:1. A monomeric ratio within the range of about 3:1 to 1:3 is also preferred. A preferred molecular weight range is about 1,000 to 25,000, and even more preferably from about 8,000 to 12,000.

Especially useful copolymers as part of the degreaser composition include the following structures. A polycarboxylate copolymer with a molecular weight of about 12,000, and X=Na, A=COONa, A'=$C_5H_{11}$, A"=$CH_3$ and the monomeric ratio is about 1:1 (Polycarboxylate A in the examples). A polycarboxylate copolymer with a molecular weight of about 70,000, X=Na, A=COONa, A'=$OCH_3$, A"=H and the monomeric ratio is about 1:1 (Polycarboxylate B in the examples). In addition, polyacrylic acid with a molecular weight of about 8,000, where X=Na is also effective as part of the invention. This polyacrylic acid may be obtained from BASF Corp. under the trademark SOKALAN® PA 30 CL (Polycarboxylate C in the examples).

The polycarboxylate polymer or copolymer as part of the invention is added to the degreaser composition in amounts of about 0.005 to 1% by weight based upon the total weight of the composition. Preferably, the polymer or copolymer will comprise from about 0.01 to 0.5% of the total formulation.

The degreaser composition according to the various embodiments of the invention is extremely useful in cleaning and degreasing metallic surfaces, especially in industrial applications, preferably automotive parts. The primary, though not necessarily exclusive aim of the invention is towards pressure spray washing at temperatures above room temperature in the range of about 100° to 200° F. To this end, a working example and various comparative examples are included to illustrate the invention, but in no way should be construed as limiting the scope thereof.

EXAMPLES

A widely recognized metallic surface "substrate" was utilized for all laboratory investigations. This substrate is referred to in the art as the "Q panel", made of stainless steel and conveniently cut into uniform dimensions of 2"×4".

The soil used was a mixture of paraffinic oils, greases and solid particulates associated with lubricated automotive parts and later, their cleaning. This soil was collected from the cleaning of used automotive parts and saved for the purpose of experimentation. The soil was applied to the "Q panels" in a uniform manner, with regard to amount and thickness. The amount utilized was enough to cover 1"×1"×1/16".

Laboratory washing equipment was designed and built to simulate standard spray washing conditions for automotive parts applications. The equipment pump delivered wash solution at the rate of one gallon per minute and at two pounds per square inch pressure. Fresh wash solution was used for each soiled sample. The exit nozzle had a 5/16" diameter discharge. The wash solution temperature was monitored carefully for uniformity at about 120° F. One gallon of wash solution was recirculated through the pump to continue the cleaning operation of each soiled sample substrate. The soiled panel was held six inches from the nozzle each time. The percent of soiled surface cleaned (on a % area basis) by the wash solution was recorded by the operator for performance comparisons. Excessive foaming was also noted and disqualified the candidate surfactant(s) from further consideration. Since unheated ("cold") mineral spirits is targeted for replacement by the surfactant mix of the invention, it was one of the benchmarks for measurement.

Single surfactants in water gave neither adequate performance nor a great deal of indication of a direction in which to proceed. However, it was recognized that Iconol™ TDA 6 surfactant was a surfactant structure with a reputation of being a good wetter of oily soils and therefore became the basis for teaming it in binary surfactant systems in the above mentioned test. The results below are examples of binary systems using 10% w/w each of Iconol™ TDA 6 surfactant with those listed below. The exception was the mineral spirits, which was utilized without any surfactant:

| SURFACTANT | % CLEAN | TIME |
|---|---|---|
| Mineral Spirits (cold) | 100 | 10 sec. |
| Surfactant A | 95 | 1 min. 15 sec. |
| Surfactant B | 70 | 2 min. |
| Iconol ™ OP 10 | 100 | 50 sec. |
| Surfactant C | 100 | 30 sec. |
| INDUSTROL ® TO-16 HR Surf. | 100 | 1 min. 15 sec. |

[Surfactant A was a $C_{9-11}$ alcohol alkoxylate w/7 moles of ethylene oxide and 1 mole of butylene oxide; Surfactant B was a $(PO)_b$ $(EO)_a$ $(PO)_b$ block copolymer with $M_w$ ~ 3500, a = 7 and b total = 54. Surfactant C was a nonionic surfactant having a carbon chain length of $C_{12-15}$ with approximately 10 moles total of oxyethylate and approximately 5 moles total of oxypropylate. INDUSTROL ® TO-16 HR, a product of BASF Corp., was a high rosin tall oil w/16 moles of ethylene oxide and a $M_w$ of ~1000.]

Next, various surfactant blends were analyzed according to the above method. The temperature of each blend was about 110° F. The first three blends are comparative examples, while the next four represent ternary blends according to preferred embodiments of the invention. Also tested was a commercial preparation known as PARTSPREP®:

| SURFACTANT | % CLEAN | TIME |
|---|---|---|
| Comparative | | |
| 5% TDA6/5% Surf. C | 60 | 2 Min. |
| 5% Surf. C/5% OP 10 | 40 | 2 Min. |
| 7.5% TDA6/7.5% Surf. C | 70 | 2 Min. |
| Various Embods. of Invention | | |
| 5% each TDA 6/OP 10/Surf. C | 100 | 30 Sec. |
| 2.5% each TDA 6/OP 10/Surf. C | 80 | 1 Min. |
| 3.3% each TDA 6/OP 10/Surf. C | 90 | 1 Min. |
| 5% each TDA 8/OP 10/Surf. C | 80 | 2 Min. |
| Undiluted PARTSPREP ® (commercial degreaser avail. from GAF Corp.) | 40 | 2 Min. |

[TDA 8 refers to Iconol ® TDA 8, a product of BASF Corp., which is a tridecyl alcohol w/8 moles of oxyethylate - utilized as the alkyl oxyethylate nonionic surfactant component.]

Next, solvent was added to the ternary surfactant blend at 110° F. according to one embodiment of the invention. As is shown below, the use of solvent does nothing to improve efficacy, and in fact some of the best known and best performing solvents actually decrease the performance of surfactant based systems:

| SYSTEM | % CLEAN | TIME |
|---|---|---|
| 3.3% each TDA 6/OP 10/Surf. C w/5% ethylene glycol monotertiary butyl ether | 60 | 2 Min. |
| 3.3% each TDA 6/OP 10/Surf. C w/5% tripropylene glycol monomethyl ether | 40 | 2 Min. |

In further testing, various polycarboxylate polymers and copolymers according to the invention were added to the ternary blend of surfactants heretofore set forth, again at 110° F. Results of selected polymers with 5% each of Surf.C, Iconol™ TDA 6, and Iconol™ OP 10 surfactants are shown below:

| | |
|---|---|
| Base surfactant blend alone | 25% clean @ 10 Sec.<br>50% clean @ 20 Sec.<br>100% clean @ 30 Sec. |
| Base blend w/Polycarboxylate A@ 0.2% active | 20% clean @ 10 Sec.<br>60% clean @ 20 Sec.<br>90% clean @ 30 Sec.<br>100% clean @ 40 Sec. |
| Base blend w/Polycarboxylate B@ 0.2% active | 20% clean @ 10 Sec.<br>30% clean @ 20 Sec.<br>60% clean @ 30 Sec.<br>90% clean @ 2 Min. |
| Base blend w/Polycarboxylate C@ 0.2% active | 20% clean @ 10 Sec.<br>40% clean @ 20 Sec.<br>80% clean @ 30 Sec.<br>95% clean @ 2 Min. |

Finally, excellent cleaning prowess was observed with the base surfactant blend above at 110° F., only this time with 0.02% of Polycarboxylate A additive:

Based blend w/Polycarboxylate A @0.02% active 100% clean @20 Sec.

There were of course safety and logistic concerns with using the above mentioned test method at temperatures much higher than 120° F. since this was approaching scald temperature for human skin. However, it is expected that the surfactant, the surfactant/polymer and the surfactant/copolymer blends according to the various embodiments heretofore set forth will find considerable utility for "touchless" parts degreasing at temperatures above 120° F., for example of 160° F. or more, where other solvent and/or surfactant systems failed due to excessive foaming.

It is thus within the scope of the invention to achieve about 80%, 90% or even as much as 100% cleaning efficacy in as little as about 2 minutes, more preferably about 60 seconds, and especially within about 30 seconds. In one of more embodiments of the invention, it is also possible to achieve as much as 100% clean in as little as 20 seconds or even less.

While the invention has been described in each of its various embodiments, it is to be expected that certain modifications thereto may be made by those skilled in the art without departing from the true spirit and scope of the invention as set forth in the specification and the accompanying claims.

What is claimed is:

1. An aqueous based, solvent free degreaser composition, comprising on a weight basis:

(a) about 0.5–10% of at least one alcohol alkoxylate with a fatty alcohol moiety selected from the group consisting of compounds having the formula:

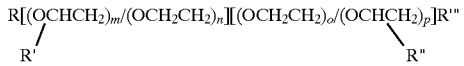

wherein R is a $C_8$ to $C_{18}$ branched or straight chain alkyl group, m is within the range of about 0 to 14, n is within the range of about 1 to 14, o is within the range of about 1–14, p is within the range of about 0–14, and R' is —$CH_3$, —$CH_2CH_3$, and mixtures thereof, R" is —$CH_3$, —O—$CH_2$ $CH_3$, and mixtures thereof, and R'" is —OH, —$CH_3$, —O—$C_3$–$C_{18}$ hydroxyalkyl group and mixtures thereof;

(b) about 0.5–10% of at least one alkyl phenol alkoxylate of the following formula:

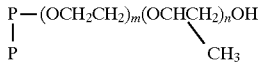

wherein R is a $C_8$ or $C_9$ branched or straight chain alkyl group, m is within the range of about 3 to 12, and n is within the range of about 0 to 12, and P is a phenyl group;

(c) about 0.5–10% of at least one alkyl oxyethylate of the following formula;

$$R\ (O\ CH_2\ CH_2)_x\ OH$$

wherein R is a $C_{10}$ to $C_{13}$ branched or straight chain alkyl group and x is within the range of about 4 to 10;

(d) about 0.005 to 1% of at least one polycarboxylate polymer or copolymer of the following formula:

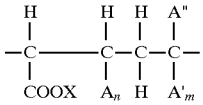

wherein x=H, alkali metal or alkaline earth metal, A=Hor COO—Y, A'=COO—Y, wherein Y=H or alkali metal or —$OCH_3$, or an alkyl group having a chain length of about 4 to 20 carbon atoms, A"=H or $CH_3$, and m and n are numbers such that the monomer ratio is within the range of about 10:1 to 1:10 and the total molecular weight of said polymer or copolymer is within the range of about 1,000 to 70,000; and (e) water; wherein further, (a) and (c) are not the same compounds.

2. The composition as claimed in claim 1, wherein the monomer ratio in component (d) is about 1:1.

3. The composition as claimed in claim 2, wherein the molecular weight of said polycarboxylate polymer or copolymer is within the range of about 1,000 to 25,000.

4. The composition as claimed in claim 3, wherein the molecular weight of said polycarboxylate polymer or copolymer is within the range of about 8,000 to 12,000.

5. The composition as claimed in claim 4, wherein said chain length in component (d) is about 6 to 10 carbon atoms.

6. The composition as claimed in claim 1, comprising about 0.01–0.5% of said polycarboxylate polymer or copolymer.

7. A method of degreasing metallic surfaces which comprises adding the composition of claim 1 thereto.

8. An aqueous based, solvent free degreaser composition, comprising on a weight basis:

(a) about 0.5–10% at least one alcohol alkoxylate with a fatty alcohol moiety selected from the group consisting of compounds having the formula:

$$R[(OCH\underset{\underset{R'}{|}}{C}H_2)_m/(OCH_2CH_2)_n][(OCH_2-CH_2)_o/(OCH\underset{\underset{R''}{|}}{C}H_2)_p]R'''$$

wherein R is a $C_8$ to $C_{18}$ branched or straight chain alkyl group, m is about 0–14, n is about 2–14, o s about 1–14, p is about 0–14 and R' is $CH_3$; $CH_2CH_3$; and mixtures thereof, R" is —$CH_3$; —$CH_2CH_3$; and mixtures thereof, and R'" is —OH; —$CH_3$; —O—$C_{3-C18}$ hydroxyalkyl group and mixtures thereof;

(b) about 0.5–10% of at least one alkyl phenol alkoxylates of the following formula:

$$\underset{\underset{P}{|}}{R}-(OCH_2CH_2)_m(OCH\underset{\underset{CH_3}{\backslash}}{C}H_2)_nOH$$

wherein R is a $C_8$ or $C_9$ branched or straight chain alkyl group, m is 3–12 and n is 0–12, and P represents a phenyl group;

(c) about 0.5–10% of at least one alkyl oxyethylate of the following formula:

$$R\ (O\ CH_2\ —CH_2)_x\ OH$$

wherein R is a $C_{10}$ to $C_{13}$ branched or straight chain alkyl group and x is about 4–10; and (d) water; wherein further, (a) and (c) are not the same compounds.

9. The composition as claimed in claim 8 wherein the ratio of components (a), (b) and (c) is about 2:1:1 to 1:2:1 to 1:1:2.

10. The composition as claimed in claim 9, wherein the total value of n and o in component (a) is about 3–14 and the total value of m and p of component (a) is about 0–14.

11. The composition as claimed in claim 10, wherein R is a $C_9$ alkyl group and m Is about 11–12 in component (b).

12. The composition as claimed in claim 11, wherein the value of R is $C_{10}$ or $C_{11}$ and the value of x is about 4 to 5 in component (c).

13. The composition as claimed in 10, wherein said value of n and o is component (a) is 8–9.

14. The composition as claimed in claim 10, wherein the value of m in component (b) is about 3–9.

15. An aqueous based solvent free degreaser composition comprising on a weight percent basis:

(a) about 0.5–10% of at least one alcohol alkoxylate with a fatty alcohol moiety selected from the group consisting of compounds having the formula:

$$R[OCH\underset{\underset{R'}{|}}{C}H_2)_m/(OCH_2CH_2)_n][(OCH_2-CH_2)_o/(OCH\underset{\underset{R''}{|}}{C}H_2)_p]R''$$

wherein R is $C_{8-18}$ branched or straight chain alkyl group, m is about 1.5, n is about 1, o is about 9, p is about 3.5, and R' is $CH_3$; $CH_2CH_3$ R" is —$CH_3$, —$CH_2CH_3$ and R'" is —OH, —$CH_3$, —O—$C_3$–$C_{18}$ hydroxyalkyl group and mixtures thereof;

(b) about 0.5–10% of at least one alkyl phenol alkoxylate of the following formula:

$$\underset{\underset{R}{|}}{P}-(OCH_2CH_2)_m(O-\underset{\underset{CH_3}{|}}{C}HCH_2)_nOH$$

wherein R is a $C_{8-9}$ branched or straight chain alkyl group, m is 10, n is 0, and P is a phenyl group;

(c) about 0.5–10% of at least one alkyl oxyethylate of the following formula:

$$R\ (O\ CH_2CH_2)_x\ OH$$

wherein R is $C_{10-13}$ branched or straight chain alkyl group, and x is about 6–8;

(d) water.

* * * * *